US009486932B2

(12) United States Patent
Baggot et al.

(10) Patent No.: US 9,486,932 B2
(45) Date of Patent: Nov. 8, 2016

(54) PERFORATION BLADE FOR PERFORATING TISSUE PRODUCTS

(71) Applicant: Kimberly-Clark Worldwide, Inc., Neenah, WI (US)

(72) Inventors: James Leo Baggot, Menasha, WI (US); Walter F. Montgomery, Broken Arrow, OK (US); Kevin B. Sartain, Evans, GA (US); Matthew Robert Wilson, Oshkosh, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 108 days.

(21) Appl. No.: 14/254,549

(22) Filed: Apr. 16, 2014

(65) Prior Publication Data

US 2015/0298340 A1 Oct. 22, 2015

(51) Int. Cl.

| | |
|---|---|
| ***B26D 1/22*** | (2006.01) |
| ***B65H 35/08*** | (2006.01) |
| ***B26F 1/18*** | (2006.01) |
| ***B26D 1/00*** | (2006.01) |
| ***B26D 1/02*** | (2006.01) |

(52) U.S. Cl.

CPC ..... *B26F 1/18* (2013.01); *B26D 1/0006* (2013.01); *B26D 1/025* (2013.01); *B26D 2001/006* (2013.01)

(58) Field of Classification Search

CPC ..... B26F 1/18; B26D 1/025; B26D 1/0006; B26D 2001/006

USPC ..... 83/130, 879, 510, 678, 658

See application file for complete search history.

(56) References Cited

U.S. PATENT DOCUMENTS

| | | | | |
|---|---|---|---|---|
| 4,972,747 A * | 11/1990 | Boyd | B26D 7/2614 | 101/226 |
| 5,161,442 A | 11/1992 | Rilitz et al. | | |
| 5,205,454 A | 4/1993 | Schutz et al. | | |
| 5,537,905 A * | 7/1996 | Zimmer | B26D 1/0006 | 83/660 |

(Continued)

FOREIGN PATENT DOCUMENTS

| | | | |
|---|---|---|---|
| JP | EP 1506875 A2 * | 2/2005 | B26F 1/18 |
| WO | WO 87/04658 | 8/1987 | |

(Continued)

OTHER PUBLICATIONS

Japanese Abstract of JP2002166391(A), dated Jun. 11, 2002, 2 pages.

(Continued)

*Primary Examiner* — Omar Flores Sanchez

(74) *Attorney, Agent, or Firm* — Dority & Manning, P.A.

(57) ABSTRACT

An apparatus for perforating sheet materials is disclosed. The apparatus includes a perforation blade that defines a plurality of teeth for perforating sheet materials, such as tissue products. Each tooth on the perforation blade is defined by a pair of opposing side walls. The teeth are separated along an edge of the perforation blade by a plurality of recesses. In accordance with the present disclosure, the side walls have a non-zero angle with respect to the length direction of the blade. In one embodiment, each recess can have a slanted U-shape such that all of the side walls are parallel. In an alternative embodiment, the recesses can have a V-shape such that adjacent side walls extend in divergent directions. Perforation blades made according to the present disclosure prevent snagging and picking when a material is perforated.

18 Claims, 4 Drawing Sheets

(56) References Cited

U.S. PATENT DOCUMENTS

| | | | | |
|---|---|---|---|---|
| 5,562,964 | A | 10/1996 | Jones | |
| 5,582,571 | A * | 12/1996 | Simpson | B26F 1/18 493/355 |
| 6,010,090 | A | 1/2000 | Bushmaker et al. | |
| 6,119,439 | A * | 9/2000 | Stevie | B26D 1/626 53/455 |
| 6,368,689 | B1 * | 4/2002 | Connor Sledge | A47K 10/16 428/43 |
| 6,447,864 | B2 | 9/2002 | Johnson et al. | |
| 6,913,673 | B2 | 7/2005 | Baggot et al. | |
| 7,988,607 | B2 | 8/2011 | Baggot et al. | |
| 8,287,976 | B2 | 10/2012 | Hupp | |
| 8,468,938 | B2 | 6/2013 | Redd | |
| 8,535,483 | B2 | 9/2013 | McNeil et al. | |
| 8,802,211 | B2 * | 8/2014 | Cattacin | B31D 1/0031 428/43 |
| 2008/0028902 | A1 | 2/2008 | Baggot et al. | |
| 2008/0280088 | A1 | 11/2008 | Baum | |
| 2009/0301922 | A1 * | 12/2009 | Chapman | B65D 71/08 206/499 |
| 2010/0167896 | A1 | 7/2010 | Hada et al. | |
| 2014/0041504 | A1 * | 2/2014 | Schwartz | B26D 3/06 83/880 |

FOREIGN PATENT DOCUMENTS

| | | |
|---|---|---|
| WO | WO 97/23398 | 7/1997 |
| WO | WO 01/60730 A2 | 8/2001 |

OTHER PUBLICATIONS

International Search Report and Written Opinion for PCT/IB2005/052200, dated Jul. 13, 2015, 13 pages.

* cited by examiner

PERFORATION BLADE FOR PERFORATING TISSUE PRODUCTS

BACKGROUND

Rolled tissue products, as well as other rolled paper or nonwoven products, are typically perforated ("perfed") in order to facilitate the tearing off of the desired length of product for the intended use in a neat and undamaged fashion. In tissue products, the perforations facilitate easy removal of the required number of sheets. The perforations are normally provided in transverse perforation lines across the roll width, which are uniformly spaced in the machine direction of the roll. The lines of perforations comprise alternating bonds and perfs which are of uniform length and spacing. The perfs are typically rectangular slits or round holes with transverse orientation.

Perforating devices are well known in the papermaking art and are incorporated into almost all bathroom tissue and towel winders as well as other converting equipment in a typical tissue manufacturing and converting plant. In the past, conventional devices typically comprised a perforator roll, which holds a number of perf blades, and a stationary anvil head.

In the converting process, a balance must be struck between having perforation lines that have sufficient bond strength to operate efficiently and without breaks on the converting equipment, and yet have low enough bond strength to provide easy and undamaged sheet detaching for the consumer. Nevertheless, in spite of efforts to achieve this proper balance, poor detaching has been the subject of various consumer complaints for rolled tissue products such as toilet tissue or kitchen towels.

The above problems become exacerbated when attempting to perforate thicker, heavier and multiple-ply tissue sheets. Thicker and heavier tissue sheets, for instance, are more difficult to perforate cleanly and efficiently. The tissue sheet tends to be grabbed by the perf blade or gets stuck in the perf blade which can create uneven perforations or tearing of the sheet.

In view of the above, a need exists for a new method and apparatus for perforating tissue sheets, especially thicker and heavier tissue sheets.

SUMMARY

In general, the present disclosure is directed to an apparatus for perforating sheet materials, such as tissue sheets. In accordance with the present disclosure, the apparatus includes a perforation blade having specially shaped teeth. The specially designed perforation blade prevents snagging and picking of the sheet. Of particular advantage, the blade of the present disclosure has also been found to work well when installed in a stationary position as will be described in greater detail below.

The apparatus of the present disclosure is for perforating continuous sheet materials. The apparatus comprises an anvil and a perforation blade. In one embodiment, the perforation blade may rotate to strike the anvil. In an alternative embodiment, however, the anvil may rotate and strike the perforation blade. In this embodiment, the perforation blade remains stationary. Having the perforation blade be stationary in the apparatus can provide various advantages. For instance, the blade can easily be replaced, minimizing downtime of the process. Alternatively, the stationary member can have multiple blades installed requiring just a turn of the member to a new blade for a grade change to a different perforation pattern. It is generally more difficult, however, to perforate sheet materials cleanly and efficiently with a stationary blade. The blade design of the present disclosure, however, overcomes problems experienced in the past.

In accordance with the present disclosure, the perforation blade comprises a blade member that has a length along a longitudinal axis and terminates along an edge. The edge defines a plurality of teeth configured to contact a sheet material and form perforations. Each tooth includes a sheet contacting surface having a width for creating more than a point contact with a sheet material. Each tooth can include two opposing side walls located on opposite sides of the sheet contacting surface.

The teeth are spaced apart along the edge of the perforation blade and are separated by recesses. Each recess is bordered by two side walls of two adjacent teeth. Each recess has a width along the edge of the blade member and a depth that extends along the bordering side walls. In accordance with the present disclosure, each side wall within each recess is at a non-zero angle in relation to the longitudinal axis.

In one embodiment, for instance, the non-zero angles are all equivalent in relation to the longitudinal axis. The side walls can all extend in the same direction and be parallel to each other. In an alternative embodiment, the side walls may extend in divergent directions. For instance, a first group of side walls may extend in a first direction and be parallel with each other. A second group of side walls may extend in a different direction and be parallel with each other. In one embodiment, the recesses have a V-shape.

In one embodiment, the non-zero angle of the side walls can be from about 2° to about 40°, such as from about 5° to about 20°. All of the recesses on the perforation blade can have substantially the same shape. Further, all of the teeth can have substantially the same width so as to produce uniform perforations.

In one embodiment, each tooth includes a pair of opposing faces separated by the two opposing side walls. At least one of the faces includes a chamfer that extends along a portion of the recess and terminates at the edge of the perforation blade.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
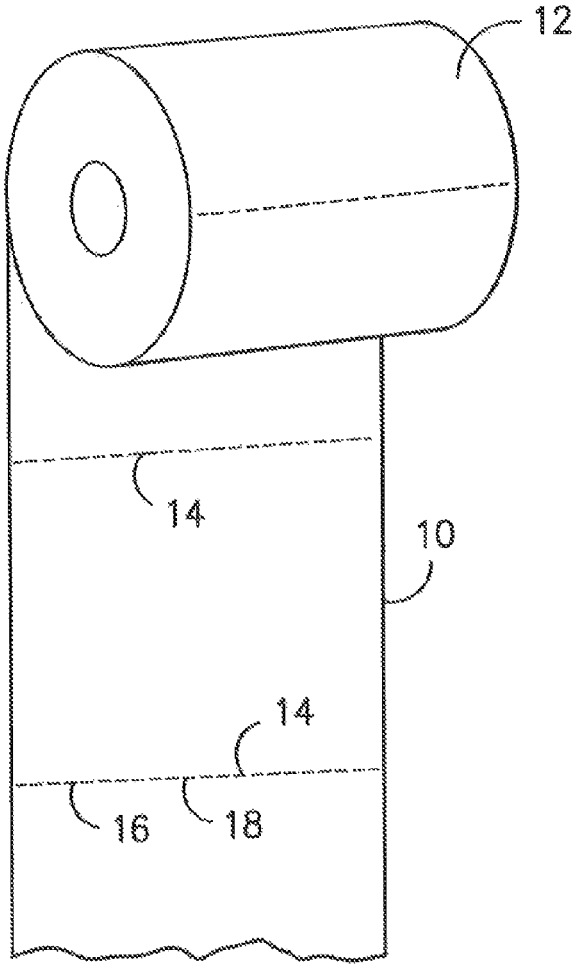
FIG. 1 is a perspective view of a spirally wound product made in accordance with the present disclosure that includes a plurality of spaced-apart perforation lines.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to an apparatus for perforating sheet materials and to a process for perforating sheet materials. More particularly, the present disclosure is directed to a specially designed perforation blade. The perforation blade includes a plurality of teeth. In accordance with the present disclosure, each tooth includes at least one angled side wall.

In the past, perforation blades typically included teeth with straight side walls. Angled side walls as taught according to the present disclosure, however can provide various advantages and benefits. The perforation blade of the present disclosure, for instance, has been found to perforate sheet materials more cleanly and efficiently than conventional perforation blades. Perforation blades according to the present disclosure also inhibit or prevent snagging or picking of the sheet material during the perforation process. Ultimately, due to less snagging and picking of the sheet, the perforation process can occur with less strength degradation or variability and at increased speeds.

In one embodiment, each tooth can be separated by a V-shaped recess area formed by two adjoining side walls. In this embodiment, each tooth has an expanding width as the tooth penetrates a sheet material. The expanding width of the tooth forms a perforation in the sheet material while further preventing the sheet material from being caught in the recess area of the blade.

As will be described in greater detail below, the perforation blades of the present disclosure are particularly well suited for use in systems where the perforation blade remains stationary and strikes against a moving anvil. It was discovered that the design of the perforation blade in accordance with the present disclosure allows for the blade to be used in a stationary position while still perforating sheet materials, including sheet materials that are thicker and have a heavier basis weight.

Sheet materials that may be perforated in accordance with the present disclosure can vary depending upon the particular application. The tissue product may have a single layer or may have a multi-layer construction. In one embodiment, the sheet material may comprise a tissue product. Tissue products that may be perforated in accordance with the present disclosure include facial tissues, bath tissues, paper towels, wipers, and the like.

In one embodiment, the sheet material may contain pulp fibers. Pulp fibers include natural cellulosic fiber sources such as softwood fibers, hardwood fibers, non-woody fibers, and mixtures thereof. In general, pulp fibers can be present in the sheet material in an amount of at least about 50% by weight, such as at least about 60% by weight, such as at least about 70% by weight, such as at least 80% by weight, such as at least 90% by weight, such as even 100% by weight. In addition to pulp fibers, the sheet material may contain other suitable fibers, such as synthetic fibers. Synthetic fibers include polymer fibers, such as polyester fibers, nylon fibers, or polyolefin fibers such as polypropylene fibers.

When perforating tissue products, the sheet material can have a relatively high bulk. For instance, the bulk of the sheet material can be greater than about 3 cc/g, such as greater than about 5 cc/g, such as greater than about 7 cc/g, such as greater than about 9 cc/g. In general, the bulk is less than about 20 cc/g, such as less than about 15 cc/g.

Especially when perforating tissue products, the basis weight of the sheet material can generally be greater than about 8 gsm, such as greater than about 10 gsm, such as greater than about 12 gsm. The basis weight is generally less than about 150 gsm, such as less than about 140 gsm, such as less than about 130 gsm, such as less than about 120 gsm, such as less than about 110 gsm, such as less than about 100 gsm, such as less than about 90 gsm. The present disclosure is particularly well suited to perforating thicker sheet materials and heavier sheet materials. In this regard, the present disclosure is well suited to perforating tissue products having a basis weight of greater than about 20 gsm, such as greater than about 25 gsm, such as greater than about 30 gsm. In one embodiment, for instance, the sheet material can have a basis weight of from about 20 gsm to about 100 gsm, such as from about 20 gsm to about 90 gsm. When perforating multi-ply tissue products, the basis weight can be calculated by adding together the basis weight of the different plies.

The manner in which the sheet material is formed can vary and is generally not critical to the present disclosure. For example, the sheet material, when comprised of a tissue product, may be formed through a wet lay process. In a wet lay process, the fiber furnish is combined with water to form an aqueous suspension. The aqueous suspension is then spread onto a wire or felt and dried to form the web. In one embodiment, the tissue web can be adhered to a creping surface and creped to the surface to form a creped web. Alternatively, an uncreped web may be formed, such as an uncreped, through-air dried web.

One embodiment of a perforated tissue web in accordance with the present disclosure is shown in FIG. 1. In this embodiment, the tissue web 10 is wound upon itself to form a spirally wound roll 12. In accordance with the present disclosure, the tissue web 10 includes evenly spaced-apart transverse perforation lines 14. The perforation lines 14 extend across the full width of the tissue sheet 10. The perforations create a line of reduced strength which encourages the tearing off and separation of individual sheets of a predetermined size. The perforation lines 14 are comprised of individual bonded lengths 16 spaced apart by perforations or perfs 18. As shown in FIG. 1, the perfs 18 have a width. In general, the bonded lengths 16 have a width that is shorter than the perfs 18. Typically the bonded area is from 10% to 40% of the overall width. A typical bond width can range from 0.010" to 0.050" with a cut area ranging from 0.050" to 0.200" depending on the desired pattern, bond area and strength desired.

Figure 2:
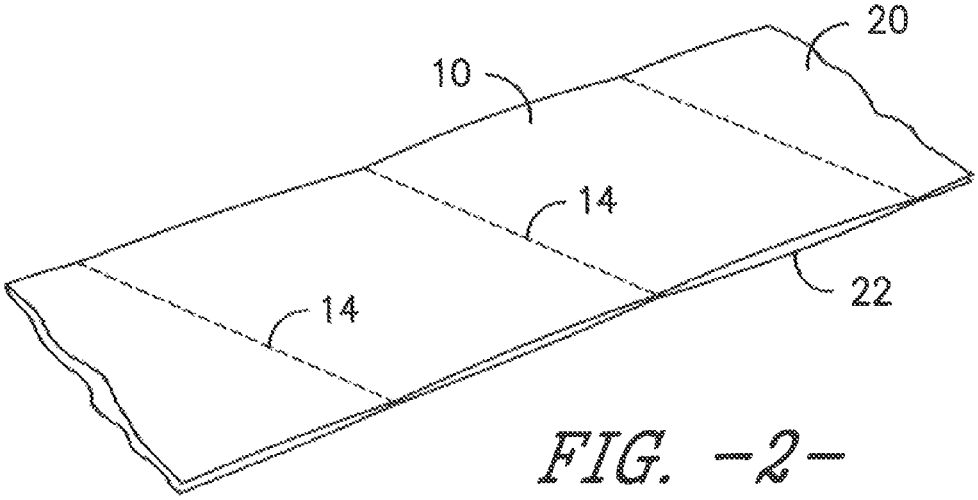
FIG. 2 is a perspective view of another product in accordance with the present disclosure that includes multiple plies and spaced-apart perforation lines.

Referring to FIG. 2, another embodiment of a perforated sheet material in accordance with the present disclosure is shown. Like reference numerals have been used to indicate similar elements.

As shown in FIG. 2, the sheet material 10 includes evenly spaced-apart transverse perforation lines 14. The sheet material 10 may comprise a tissue product, such as a bath tissue. In the embodiment illustrated in FIG. 2, the sheet material 10 includes multiple plies of material. In particular, the sheet material 10 includes a first ply 20 laminated to a second ply 22. In other embodiments, the sheet material 10 may include more than two plies, such as from about two to about five plies, such as from about two to about three plies. Perforating multiple-ply products can be somewhat difficult since the plies have a tendency to move relative to one another. Multiple-ply products are typically also thicker and have a greater basis weight than single-ply products.

Figure 3:
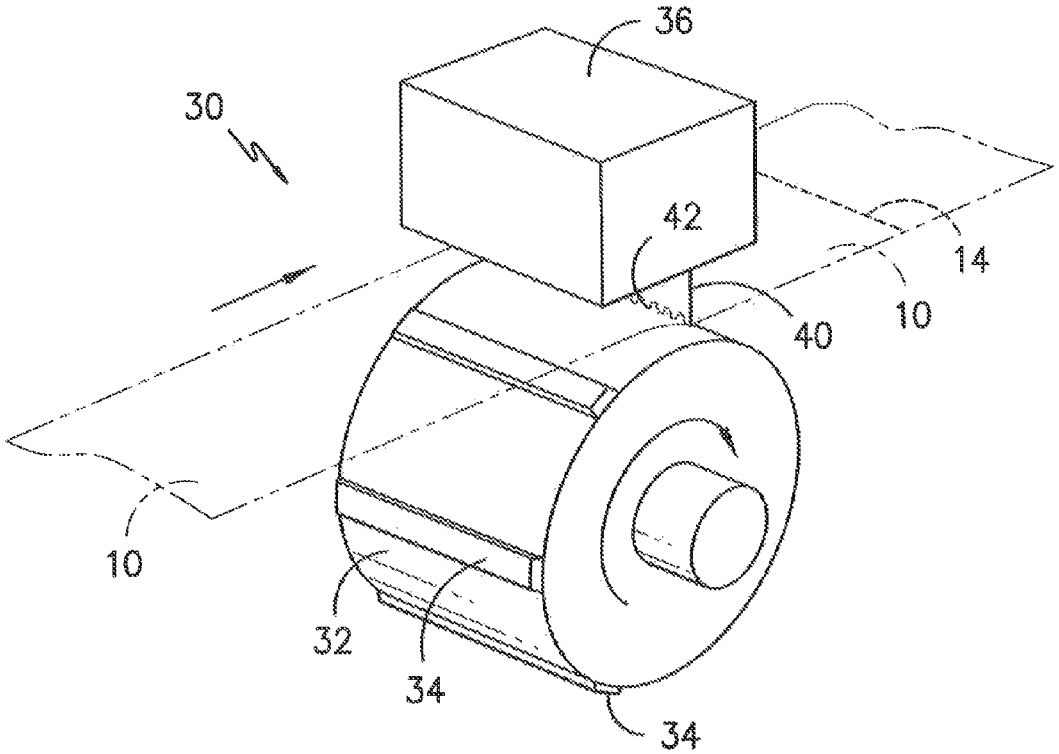
FIG. 3 is a perspective view of one embodiment of an apparatus for perforating sheet materials in accordance with the present disclosure.

Referring to FIG. 3, one embodiment of an apparatus 30 that may be used to perforate sheet materials in accordance with the present disclosure is illustrated. As shown, the apparatus 30 includes roll 32 that includes a plurality of anvils 34 arranged around the circumference of the anvil roll 32 with equal spacing. Each anvil can be mounted with a helix angle. The helix angle can limit the blade contact to a single point to eliminate vibration. A typical helix angle can be from about 2° to about 10°, such as from about 4° to about 7°.

The apparatus further includes a blade head 36 for holding a perforation blade 40 made in accordance with the present disclosure. The blade 40 includes an edge that defines a plurality of teeth 42. The perforation blade 40 is disposed adjacent to the anvil roll such that the teeth 42 interfere with the path of travel of the anvils 34 as the anvil roll 32 rotates. This interference can range from about 0.003 inches to about 0.02 inches, such as from about 0.005 inches to about 0.01 inches.

A sheet material 10 is conveyed between the perforation blade 40 and the anvil roll 32. As the sheet material 10 passes between the blade head 36 and the anvil roll 32, one of the anvils 34 strikes the perforation blade 40 and forms a perforation line 14 into the sheet material 10. The spacing of the anvils 34 on the anvil roll 32 and the speed at which the anvil roll 32 rotates relative to the sheet material 10 as it is conveyed determines the distance between transverse perforation lines 14.

In one embodiment, the anvils 34 include an incline surface that contacts the teeth 42 of the perforation blade 40. As the anvil 34 contacts the perforation blade 40, the impact force between the teeth and the anvil increases until the anvil passes by the perforation blade. As the anvil moves past the perforation blade, an edge on the teeth forms perforations into the sheet material 10. During this process, the perforation blade 40 strikes the moving anvil and is deflected as the anvil rotates beyond the blade. The roll blade is typically mounted at a 45 degree angle relative to the roll surface, while the stationary blade is mounted with a slightly greater angle of approximately 60 degrees.

In the embodiment illustrated in FIG. 3, the anvils 34 rotate and strike the perforation blade 40. In an alternative embodiment, however, a plurality of perforation blades may be mounted on a rotating roll and strike a stationary anvil. For many applications, having the perforation blade remain stationary during the perforation process presents difficulties in forming uniform perforation lines without experiencing associated problems related to snagging and tearing of the sheet material during the process. The present disclosure, however, is directed to a specially designed blade that not only works efficiently in a stationary blade system, but is also capable of forming uniform perforation lines in thicker and heavier materials while minimizing snagging of the sheet material against the blade.

Having the capability to use the perforation blade in a stationary system as shown in FIG. 3 provides various advantages and benefits. For example, in one embodiment, multiple blades can be installed on the blade head 36 for quick and easy grade changes in comparison to having to change multiple blades on a rotating roll.

Figure 4:
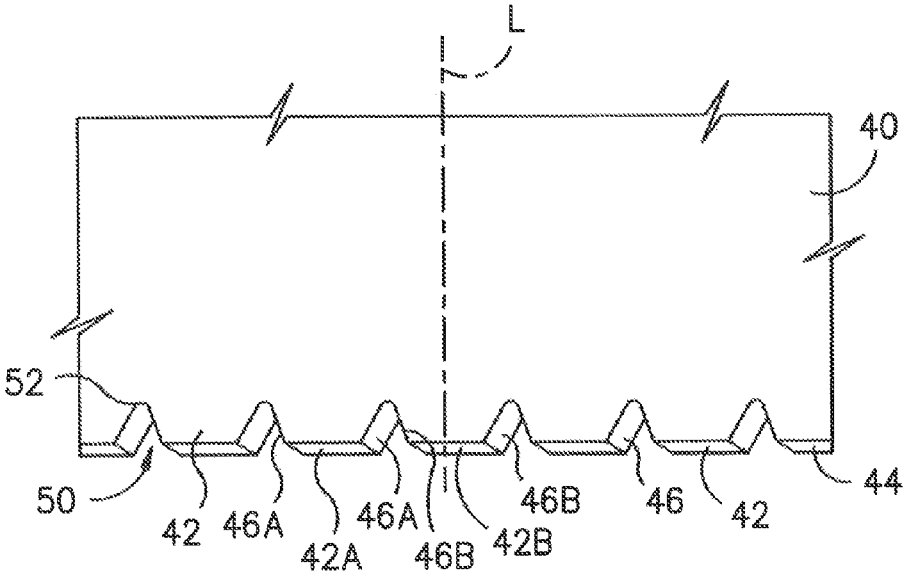
FIG. 4 is a perspective view of one embodiment of a perforation blade in accordance with the present disclosure.

In general, perforation blades in accordance with the present disclosure include teeth that have at least one and preferably two angled side walls. One embodiment of a perforation blade made in accordance with the present disclosure is illustrated in FIG. 4. As shown, the perforation blade 40 comprises a blade member that has a length along a longitudinal axis L. The length of the perforation blade 40 terminates along an edge 44. The edge 44 defines the plurality of teeth 42. Each tooth 42 has a width along the edge 44 for contacting a sheet material. The width of each tooth 42 forms a corresponding perforation into a sheet material during the perforation process. In general, each tooth has a width so as to form more than a point contact with a sheet material. Consequently, perforations formed in the sheet material also have a width along a perforation line.

As shown in FIG. 4, each tooth 42 is bordered by two opposing side walls 46. For example, tooth 42A includes side walls 46A, while tooth 42B includes side walls 46B. Two side walls from adjacent teeth form a recess 50. The recesses 50 form bonds into the sheet material that separate the perforations along the perforation line.

In accordance with the present disclosure, the side walls 46 form a non-zero angle in relation to the longitudinal axis L. In the embodiment illustrated in FIG. 4, the recesses 50 have a V-shape. In this regard, every other side wall spaced along the edge 44 are parallel along a first direction. The remaining side walls are parallel along a second and different direction.

In the embodiment illustrated in FIG. 4, each recess 50 has a depth. Each recess 50 terminates at an arcuate section 52. The arcuate section 52 generally has a U-shape. From the arcuate section 52, each side wall 46 has a constant and continuous non-zero angle with the longitudinal axis L to the edge 44 of the perforation blade 40.

The blade design as shown in FIG. 4 has been found to reduce problems experienced with snagging and picking of the sheet material against the blade, especially when perforating thicker and heavier sheet materials, such as tissue sheets. In the embodiment illustrated in FIG. 4, each tooth 42 has an expanding width as the tooth penetrates the sheet material. In this regard, the size of the perforations formed into the sheet material expand from a first width during initial contact with the tooth to a final width depending on how far each tooth penetrates into the sheet material. The expanding width of each tooth prevents the sheet material from being caught in the recesses of the blade.

In general, the angle of each side wall can be the same or different. In one embodiment, all of the angles have the same measurement with respect to the longitudinal axis L, albeit a first group of side walls extend in a divergent direction from a second set of side walls. The angle of the side walls is generally greater than about 2°, such as greater than about 5°, such as greater than about 7°, such as greater than about 10°, such as greater than about 12°, such as greater than about 15°. The angle is generally less than about 60°, such as less than about 40°, such as less than about 35°, such as less than about 30°, such as less than about 25°.

Along the edge 44 of the perforation blade 40, the width of each tooth 42 can be from about 0.050" to about 0.200", while the width of each recess can be from about 0.010" to about 0.050".

Figure 5:
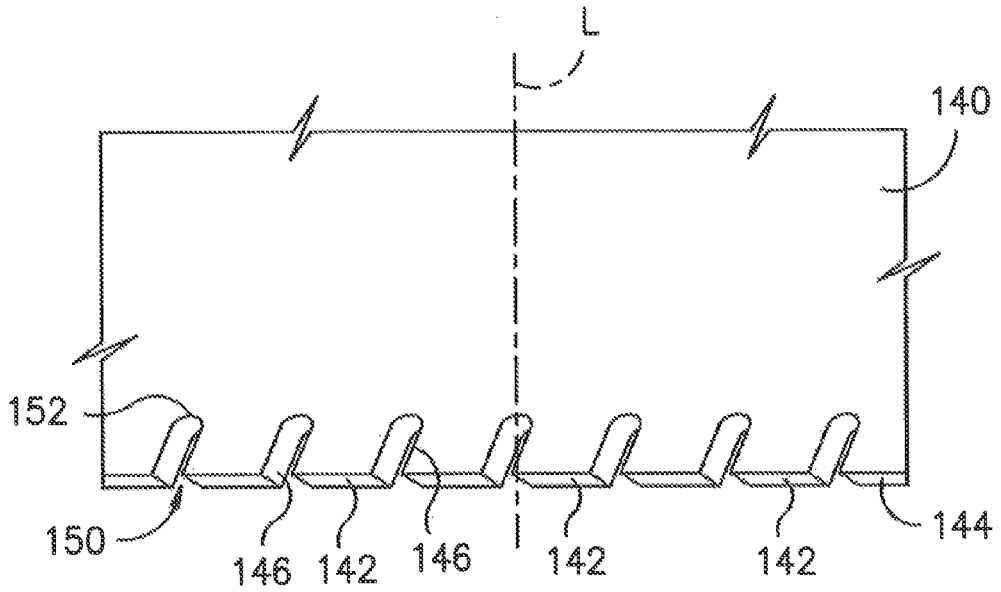
FIG. 5 is a perspective view of another embodiment of a perforation blade made in accordance with the present disclosure.

Referring to FIG. 5, another embodiment of a perforation blade 140 in accordance with the present disclosure is shown. The perforation blade 140 includes a plurality of teeth 142. Each tooth 142 defines opposing side walls 146.

Each tooth 142 is separated by a recess 150. Each recess 150 has a depth and terminates at an arcuate section 152.

The side walls 146 of the teeth 142 form a non-zero angle with a longitudinal axis L. In the embodiment illustrated in FIG. 5, all or substantially all of the side walls are parallel with respect to one another. In this manner, each recess 150 has a "slanted" U-shape. In other words, in the embodiment illustrated in FIG. 5, the side walls 146 all form common angles as opposed to alternating angles as shown in the embodiment illustrated in FIG. 4.

In the embodiment illustrated in FIG. 5, the side walls generally have an angle that substantially matches the angle of the cutting action. In this manner, the teeth 142 form perforations into a sheet material while minimizing snagging or picking of the web. In particular, by matching the angle of the cutting action, the web is prevented from being pushed sideways into the recesses of the blade thus minimizing snagging.

In general, the side walls 146 of the perforation blade 140 can form an angle with the longitudinal axis L generally similar to the angles described above with respect to FIG. 4. For instance, each side wall may form a constant and continuous angle with the longitudinal axis L of greater than about 2°, such as greater than about 5°, such as greater than about 7°, such as greater than about 10°, such as greater than about 12°, such as greater than about 15°. The angle is generally less than about 60°, such as less than about 40°, such as less than about 30°, such as less than about 20°.

In the embodiment illustrated in FIG. 5, each tooth 142 can generally have a width of from about 0.050" to about 0.200". Each recess 150 along the edge 144 can have a width of from about 0.010" to about 0.050". Each recess can have a depth of from about 0.040" to about 0.100".

Figure 6:
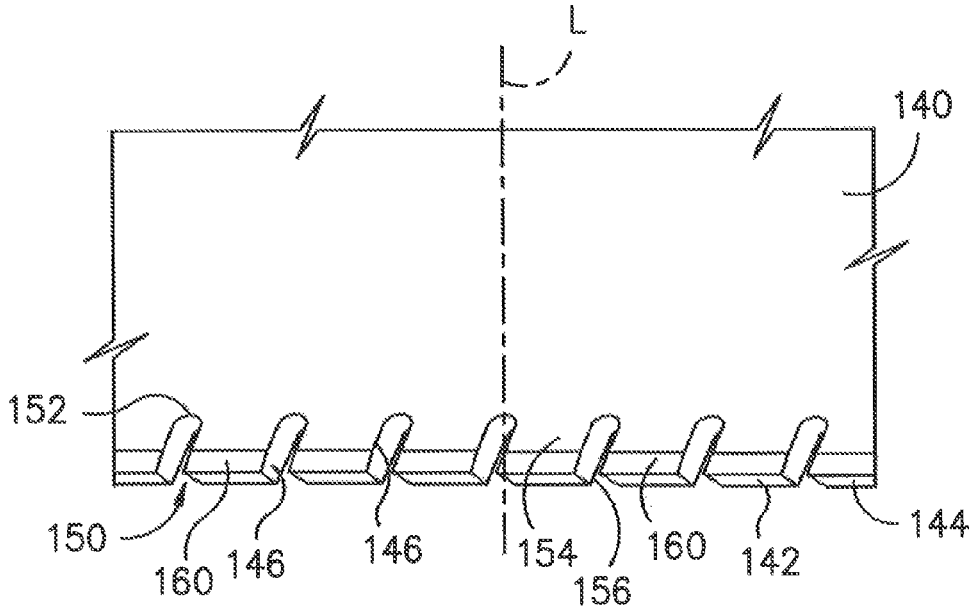
FIG. 6 is a perspective view of another embodiment of a perforation blade made in accordance with the present disclosure.

Referring to FIG. 6, still another embodiment of a perforation blade made in accordance with the present disclosure is shown. The perforation blade illustrated in FIG. 6 is similar to the perforation blade illustrated in FIG. 5. Consequently, like reference numerals have been used to show similar elements.

The perforation blade 140 as shown in FIG. 6 includes a plurality of teeth 142 separated by recesses 150. Each recess 150 is defined by two opposing side walls 146 that are part of adjacent teeth 142. The side walls are all generally parallel and form a non-zero angle with a longitudinal axis L.

In the embodiment illustrated in FIG. 6, each tooth 142 includes a pair of opposing faces 156 and 158. In accordance with the present disclosure, the face 154 includes a chamfer 160. The chamfer 160 extends along a portion of the recesses 150 and terminates at the edge 144 of the perforation blade 140. The chamfer 160 forms a beveled face. The chamfer 150 is placed on the face 154 of each tooth 142 on the side of the tooth that contacts a corresponding anvil to perforate a sheet material. The chamfer 160 further prevents snagging with a sheet material during the perforation process.

The chamfer 160 forms an inclined angle along the face 152 of each tooth 142. The angle extends to the edge 144 of the blade 140. The chamfer can have an angle of generally greater than about 3°, such as greater than about 5°, such as greater than about 7°. The chamfer generally has an angle less than about 20°, such as less than about 15°, such as less than about 12°.

In FIG. 6, the chamfer 160 is formed into the perforation blade 140 as shown in FIG. 5. It should be understood that the same or a similar chamfer can also be formed into the perforation blade 40 as shown in FIG. 4.

Figure 7:
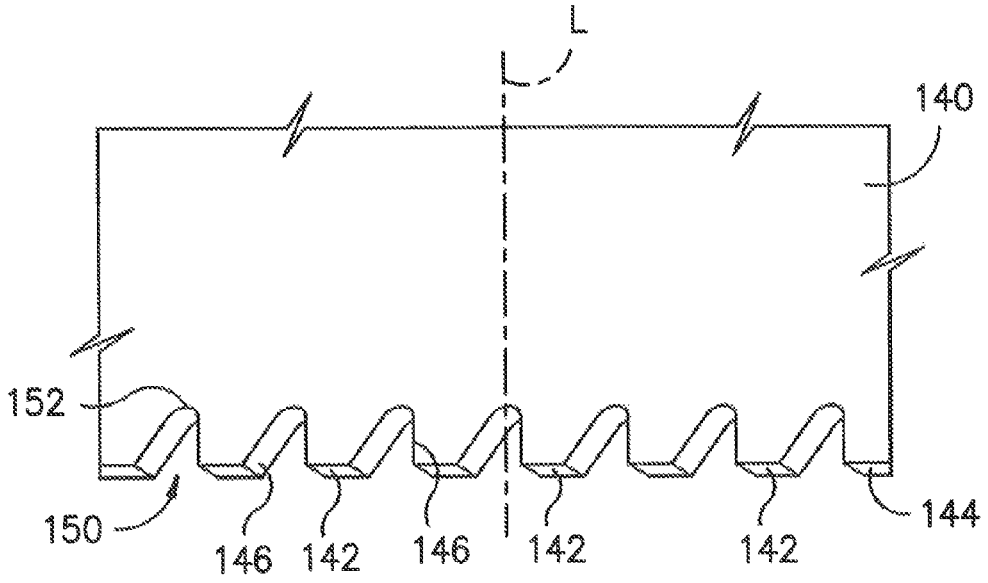
FIG. 7 is a perspective view of yet another embodiment of a perforation blade made in accordance with the present disclosure.

Referring to FIG. 7, yet another embodiment of a perforation blade made in accordance with the present disclosure is shown. Like reference numerals have been used to represent similar elements.

The perforation blade 140 as shown in FIG. 7 includes a plurality of teeth 142 separated by recesses 150. Each recess 150 is defined by two opposing side walls 146 that are part of adjacent teeth 142. In the embodiment illustrated in FIG. 7, each recess includes a slanted side wall opposite a straight side wall in relation to the longitudinal axis L. In particular, one side wall forms a non-zero angle with the longitudinal axis, while another side wall forms a zero angle with the longitudinal axis.

Similar to the embodiment illustrated in FIG. 5, one of the side walls of each recess generally has an angle that substantially matches the angle of the cutting action. In this manner, the teeth 142 form perforations into a sheet material while minimizing snagging or picking of the web.

The slanted side walls illustrated in FIG. 7 can all be parallel to each other and can form an angle with the longitudinal axis L similar to the angles described above with respect to FIG. 5.

Perforation blades made in accordance with the present disclosure can be made from various materials. For instance, the perforation blade can be made from hardened steel. Each perforation blade can have a width that is generally the same or larger than the width of the sheet material being perforated. In one embodiment, for instance, the perforation blade can have a width of greater than about 70 inches, such as greater than about 80 inches, such as greater than about 90 inches. The width of the perforation blade is generally less than about 200 inches, such as less than about 160 inches, such as less than about 140 inches, such as less than about 120 inches. The dimensions of the perforation blade, however, depend upon various factors including the type of material being perforated and the dimensions of the processing line into which the blade is installed.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for perforating a sheet material comprising:

feeding a sheet material between an anvil and a perforation blade, the perforation blade and the anvil contacting each other periodically for forming corresponding perforation lines in the sheet material, the perforation blade comprising a blade member that has a length and terminates along an edge, the edge defining a plurality of teeth configured to contact a sheet material and form perforations, each tooth including a sheet contacting surface having a width for creating more than one point contact with a sheet material thereby forming a perforation line into a sheet material, the teeth being spaced apart along the edge and being separated by recesses, each recess being bordered by two side walls of two adjacent teeth, each recess having a width along the edge of the blade member and a depth that extends along the bordering side walls, and wherein each side wall within each recess is slanted at a non-zero angle in relation to a longitudinal axis that intersects the side wall and extends perpendicular to the perforation blade edge, the non-zero angle being from 2° to about 40° , wherein the sheet contacting surface of each tooth has a width of from about 0.05 inches to about 0.2 inches.

2. A process as defined in claim 1, wherein the non-zero angles formed by the side walls are equivalent.

3. A process as defined in claim 1, wherein the side walls extend in a parallel relationship.

4. A process as defined in claim 1, wherein the side walls extend in divergent directions, a first group of side walls being parallel along a first direction and a second group of side walls being parallel along a second and different direction, each recess having a V-shape.

5. A process as defined in claim 1, wherein the sheet material comprises a tissue product, the tissue product having a basis weight of from about 30gsm to about 100 gsm.

6. An apparatus for perforating continuous sheet materials comprising:

an anvil; and a perforation blade that is configured to contact the anvil for perforating a sheet material, the perforation blade comprising a blade member that has a length and terminates along an edge, the edge defining a plurality of teeth configured to contact the sheet material and form perforations, each tooth including a sheet contacting surface having a width for creating more than one point contact with the sheet material thereby forming a perforation line into the sheet material, the teeth being spaced apart along the edge and being separated by recesses, each recess being bordered by two side walls of two adjacent teeth, each recess having a width along the edge of the blade member and a depth that extends along the bordering side walls, and wherein at least one side wall within each recess is slanted at a non-zero angle in relation to a longitudinal axis that intersects the side wall and extends perpendicular to the perforation blade edge, the non-zero angle being from 2° to about 40° , wherein the sheet contacting surface of each tooth has a width of from about 0.05inches to about 0.2 inches.

7. An apparatus as defined in claim 6, wherein the anvil moves in order to strike the perforation blade.

8. An apparatus as defined in claim 6, wherein the perforation blade stays stationary when contacting the anvil.

9. An apparatus as defined in claim 6, wherein the anvil rotates and the perforation blade remains stationary, the anvil rotates and strikes the perforation blade.

10. An apparatus as defined in claim 6, wherein each side wall within each recess is at a nonzero angle in relation to the longitudinal axis and the side walls in each recess extend in a parallel relationship.

11. An apparatus as defined in claim 6, wherein each side wall within each recess is at a non-zero angle in relation to the longitudinal axis and the side walls extend in divergent directions, a first group of side walls being parallel along a first direction and a second group of side walls being parallel along a second and different direction.

12. An apparatus as defined in claim 6, wherein the side walls extend in a parallel relationship.

13. An apparatus as defined in claim 6, wherein the side walls extend in divergent directions, a first group of side walls being parallel along a first direction and a second group of side walls being parallel along a second and different direction.

14. An apparatus as defined in claim 6, wherein each of the recesses has a V-shape.

15. An apparatus as defined in claim 6, wherein each recess has a depth that terminates in a U-shape comprising an arcuate portion.

16. An apparatus as defined in claim 6, wherein all or substantially all of the sheet contacting surfaces of the teeth have the same width.

17. An apparatus as defined in claim 6, wherein all or substantially all of the recesses have identical dimensions.

18. An apparatus as defined in claim 6, wherein each tooth includes a pair of opposing faces separated by the two opposing side walls, at least one of the faces including a chamfer that extends along a portion of the recess and terminates at the edge of the perforation blade.

* * * * *